US005787780A

United States Patent [19]

Carter

[11] Patent Number: 5,787,780

[45] Date of Patent: Aug. 4, 1998

[54] TOP ADJUSTABLE SLITTER/PERFORATOR

[75] Inventor: Daniel L. Carter, Scottsville, N.Y.

[73] Assignee: Xerox Corporation, Stamford, Conn.

[21] Appl. No.: 314,110

[22] Filed: Sep. 28, 1994

Related U.S. Application Data

[63] Continuation of Ser. No. 952,460, Sep. 29, 1992, abandoned.

[51] Int. Cl.[6] ..... B26D 1/00

[52] U.S. Cl. ..... 83/425.4; 83/498; 83/505

[58] Field of Search ..... 83/425.4, 498, 83/499, 502, 505, 407, 408, 430

[56] References Cited

U.S. PATENT DOCUMENTS

| | | | |
|---|---|---|---|
| 244,845 | 7/1881 | Bowles | 83/430 X |
| 325,812 | 9/1885 | Bridgman | 83/499 |
| 391,750 | 10/1888 | Koegel | 83/499 X |
| 393,535 | 11/1888 | Browne | 83/499 |
| 416,829 | 12/1889 | Crosby | 83/498 X |
| 823,250 | 6/1906 | Aldrich | 83/498 X |
| 3,122,040 | 2/1964 | Bishop | 83/430 X |
| 4,559,855 | 12/1985 | Schieck | 83/425.3 |
| 5,049,929 | 9/1991 | Anderson et al. | 355/204 |

*Primary Examiner*—Maurina T. Rachuba
*Attorney, Agent, or Firm*—William A. Henry, II

[57] ABSTRACT

A low cost, modular, top adjustable slitter/perforator accessory for a machine that feeds paper to an output station is disclosed. The slitter/perforator is positioned just prior to the output station and when actuated places desired combinations of slits and/or perforations in paper passing through it. The accessory allows infinite location adjustments of slits and/or perforations along the width of paper by an operator while the machine continues to transport the paper. The slitter/perforator is automatically shut off when paper is directed to the machine's finisher.

4 Claims, 6 Drawing Sheets

TOP ADJUSTABLE SLITTER/PERFORATOR

This is a continuation of application Ser. No. 07/952,460, filed Sep. 29, 1992, now abandoned.

BACKGROUND OF THE INVENTION

This invention relates to an improved, easily adjustable slitter/perforator apparatus for use as a stand alone apparatus or in an automatic reproduction machine or the like.

With the continued expansion of higher speed and more sophisticated reproduction machines in the marketplace, and with the machines being capable of more diverse applications, a need has been shown for simpler and more compact, longer life and lower maintenance sheet slitting/perforating mechanisms which is infinitely adjustable as to slit and perforation locations on copy sheets, and upon demand, can slit and/or perforate a copy sheet into a selected plural number of sub-sheets or, alternatively, permit the copy sheet to exit the machine uncut and/or unperforated, which sheet cutting/perforating apparatus can be easily and inexpensively incorporated into existing reproduction machines and operated with a minimum of operator involvement, skill or adjustments.

A plural mode copy sheet output slitter is shown in U.S. Pat. No. 4,559,855 that has cutting edges that are not in pressure contact or critical perpendicular opposition to a backing member, as is true of a number of prior slitters. Instead, they overlap and are freely slidable relative to another, parallel, cutting surface which cuts by shearing action. Even though this slitter is an improvement over previous slitters, it does not answer the need for a combination slitter/perforator that is easy to place into the copy sheet output path of a machine and is easy to adjust to the particular slit and/or perforation location desired since it is not infinitely adjustable in that it only has fixed locations for slitting with the locations being ½ and ⅓ sheet size and it is not equipped to slit 17" wide sheets.

SUMMARY OF THE INVENTION

Accordingly, a combination slitter/perforator is disclosed that is operator adjustable while the machine into which it is placed continues to operate. The slitter/perforator is operator adjustable by simply turning a screw in a housing counterclockwise, sliding the housing that includes either a cutting blade or a perforating wheel, moving the housing along a shaft to a desired slitting or perforating position, and tightening the screw clockwise to stationarily position the housing for either slitting or perforating sheets passing thereunder.

DESCRIPTION OF THE DRAWINGS

All of the above-mentioned features and other advantages will be apparent from the example of one specific apparatus and its operation described hereinbelow. The invention will be better understood by reference to the following description of this one specific embodiment thereof, which includes the following drawing figures (approximately to scale) wherein.

DETAILED DESCRIPTION OF THE PREFERRED EMBODIMENT

Figure 1:
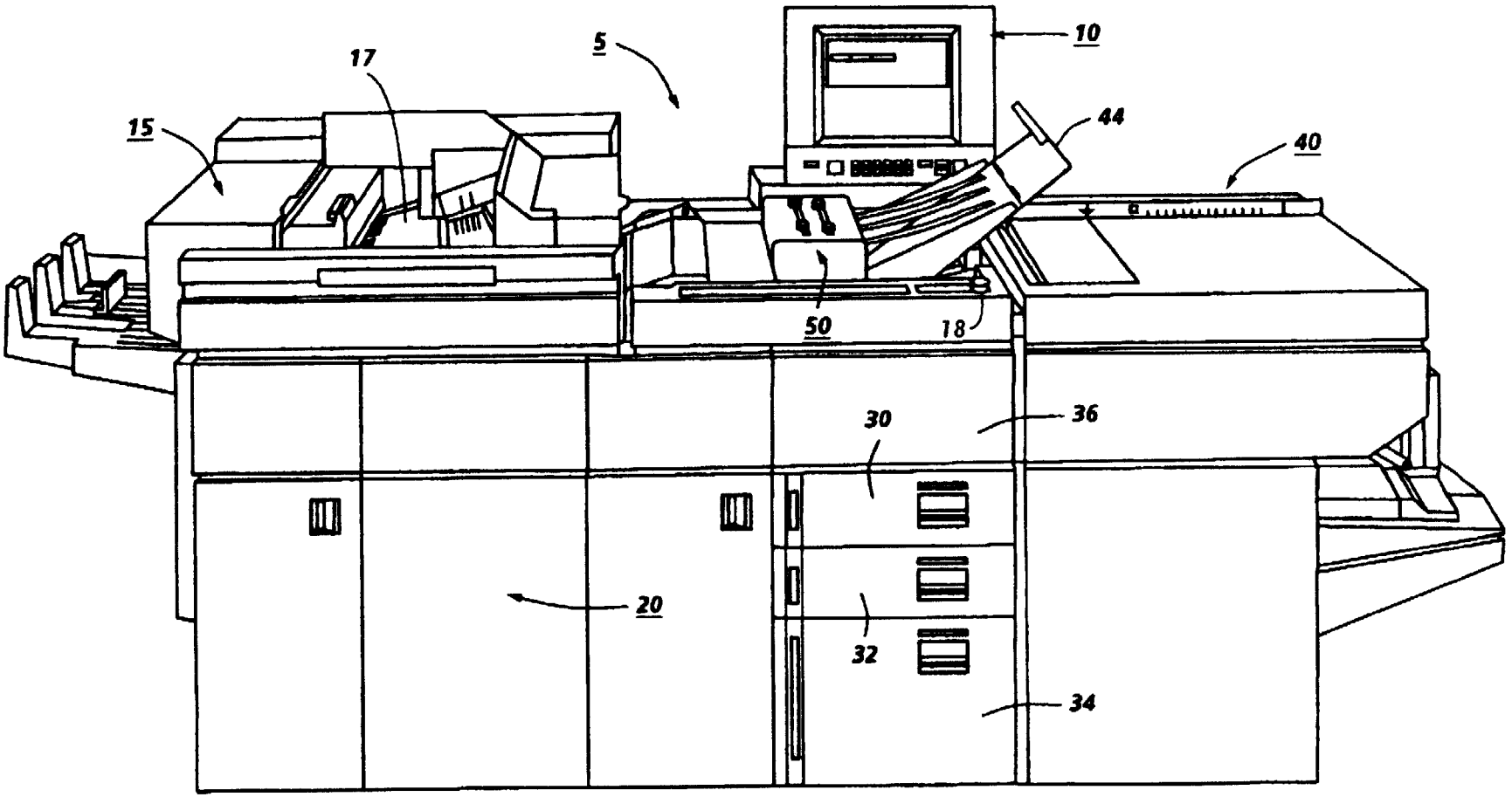
FIG. 1 is an isometric view of an illustrative reproduction machine incorporating the slitter/perforator of the present invention.

For a general understanding of the features of the present invention, reference is made to the drawings. In the drawings, like reference numerals have been used throughout to identify identical elements. Referring to FIG. 1, there is shown an electrophotographic printing machine 5 composed of a plurality of programmable components and sub-systems which cooperate to carry out the copying or printing programs through the touch dialogue User Interface (UI) 10. However, it should be understood that the apparatus of the present invention can be used as a stand-alone apparatus or with any device that feeds sheets, such as, a printer or in any environment where slitting or perforating is required.

Conventionally, machine 5 shown in U.S. Pat. No. 5,049,929 which is incorporated herein by reference, employs a recirculating document handler 15 having a document support surface 17 onto which documents are placed. The documents are fed individually to an imaging station where they are imaged within housing 20 onto a photoconductive belt corresponding to the informational areas contained within a document currently at the imaging station. After imaging, each document is returned to the document handler support surface 17 via a simplex path when either a simplex copy or the first pass of a duplex copy is being made or via a duplex path when a duplex copy is being made. Each image is developed on the photoreceptor, transferred and fused to copy sheets fed from either of paper trays 30, 32 or 34 through housing 36 to output tray 44 or finisher 40. If the slitting and/or perforating is not required, copy sheets pass through slitter/perforator 50 with it unactuated. The slitter/perforator is actuated by touching an icon on UI 10 in an appropriate location if there is a desire to slit or perforate copy sheets.

Top adjustable slitter/perforator 50 of the present invention adds easily adjustable on-line slitting and perforating capability to machine 5 as copy sheets are fed to top output tray 44. Most slitters and perforators are not easy to adjust. They require an allen wrench and must be adjusted by a service technician and are positioning limited by paper guides. In contrast, top adjustable slitter/perforator 50 is operator adjustable from the top of the apparatus simply by turning a lock adjustment knob counterclockwise, sliding slitter or perforator housings along a slot in a support shaft, lining the slitter and/or perforator up with a dimensioned label for the desired location, and turning the lock adjustment knob clockwise to lock the housing into the location. No tools are required and the unit is also adjustable while paper is moving through it, i.e., the machine does not have to stop paper movement through the machine in order for different positioning of the slitter and/or perforator housings to take place.

Figure 2:
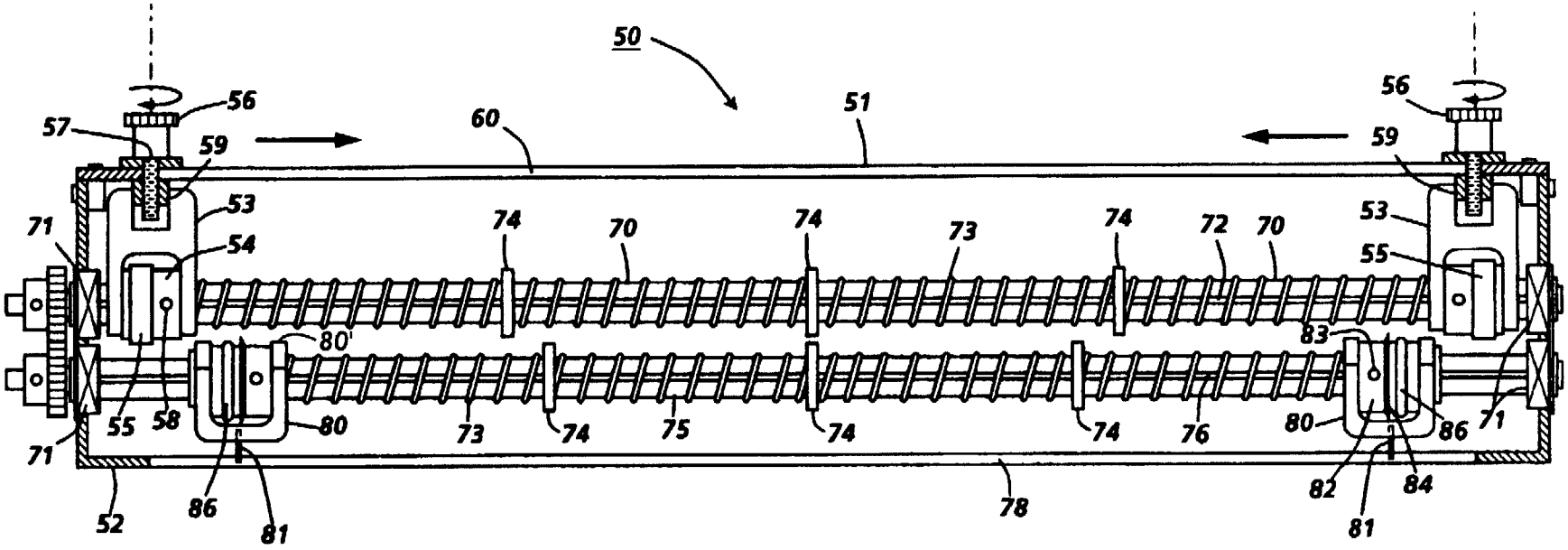
FIG. 2 is an end view of the slitter/perforator of the present invention in a non-perforating position.

In FIG. 2, an end view of the perforator portion of slitter/perforator 50 is shown encased in cover 51 and U-shaped frame member 52 and located in a non-perforating position and includes movable housings 53 which are connected to cover 51 by way of lock adjustment knobs 56. The knobs have threaded portions 57 threadably connected to movable oval shaped pin 59. The pins are oval shaped so that there is no rotation when the knobs are tightened. As knobs 56 are rotated clockwise, oval shaped pins 59 are compressed against cover 51, locking housings 53 to cover 51. Each of the oval shaped pins 59 can move up an down but not transversly as tightening takes place. When movement of housings 53 along slot 60 is desired, each lock adjustment knob 56 is turned counterclockwise and adjustment or positioning to a predetermined location is accomplished. Two shafts 70 and 75 are rotatably mounted in bushings or bearings 71 supported in U-shaped frame portion 52. Shaft 70 has slidable or transversely movable housings 53 mounted thereover through a cylindrical hole in cylinder 54. Cylinder 54 has a pin 58 interiorly protruding therefrom that rides in slot 72 in shaft 70. Shaft 75 has perforator housings 80 movably mounted thereon through cylinder 82 and pin 83 which rides in slot 76 of shaft 75. Pins 81 stabilize housing 80 within slot 78 in frame member 52. A perforating blade 84 is mounted on cylinder 82 and an O-ring 86 is positioned on cylinder 82 for ensuring that copy sheets passing thereon are level and applys frictional drive to copy sheets traveling toward output tray 44. The O-ring ensures straight slits and perforations. Housing 80 has a sheet guide surface 80' that directs the copy sheet through the housing and prevents the copy sheet from wrapping around cylinder 82 and away from the direction of travel due to the tendancy of the perforating wheel to drive sheets away from the feed path during the perforating process. Compression springs 73 are used to bias the housings outward toward the inside surfaces of U-shaped frame portion 52 and present a nearly constant sliding force to an operator when adjustment of the perforator housings is required. A slot 60 allows housings 53 to be moved toward each other in the direction of the arrows and back to their original positions. Paper guide washers 74 stay centered when adjustments are made to the perforator housings due to contact with low rate springs 73 which also apply side load on the perforator housings.

Figure 3:
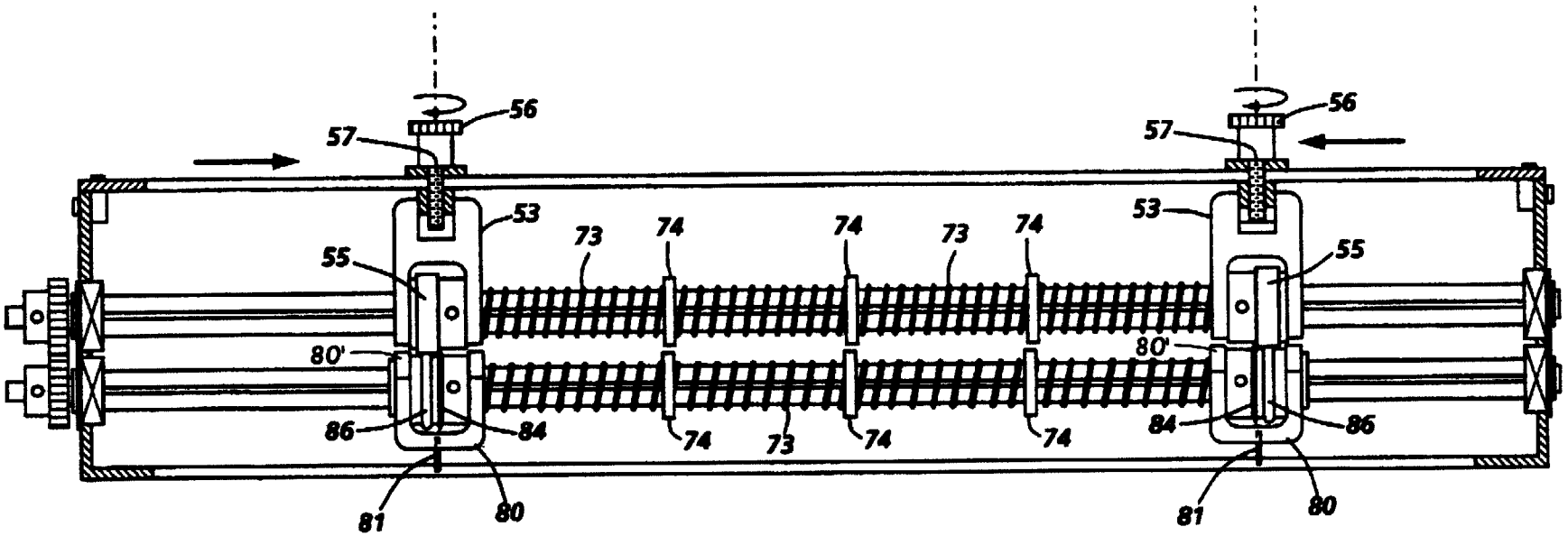
FIG. 3 is an end view of the slitter/perforator of FIG. 2 in a perforating position.
Figure 4:
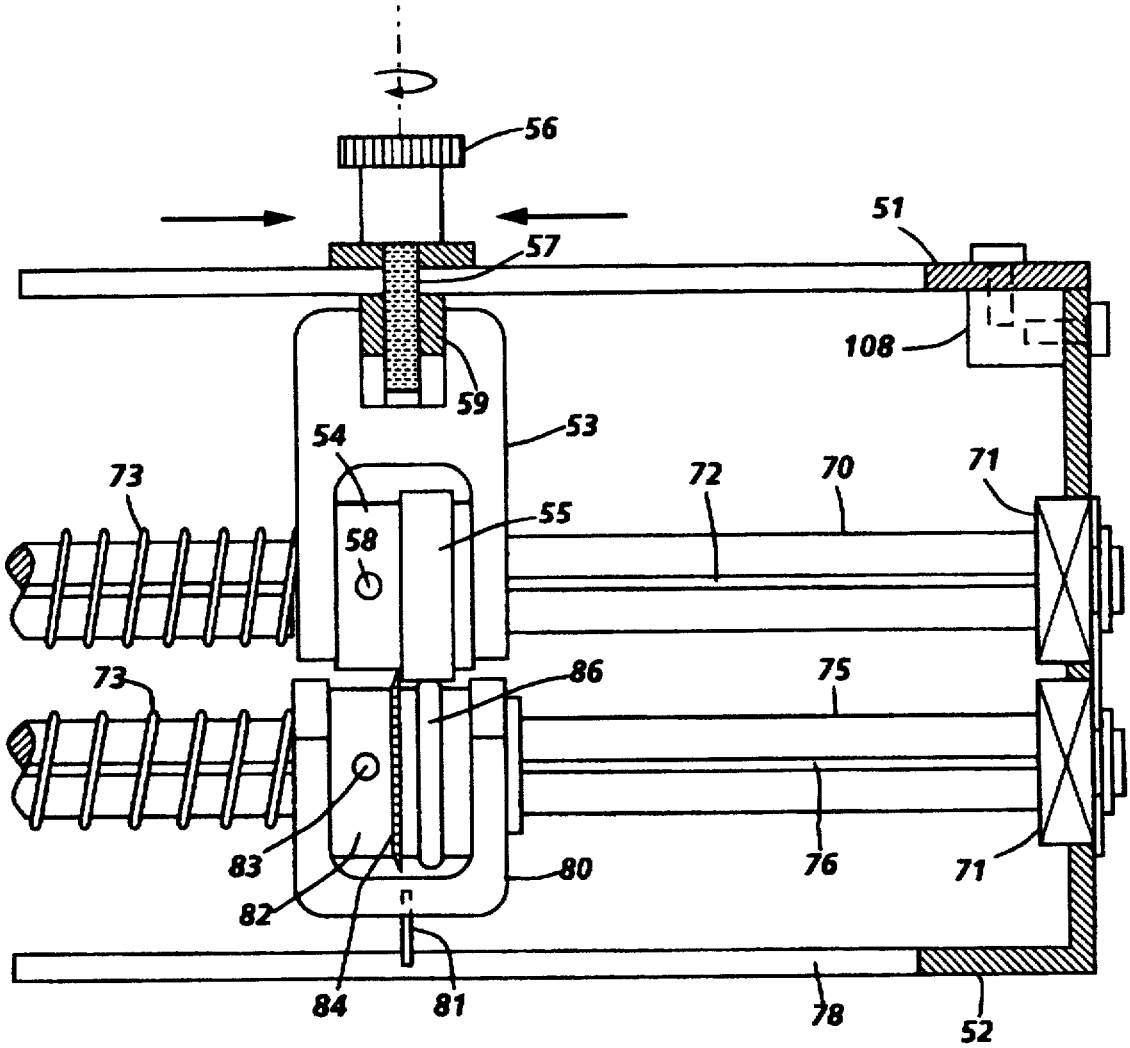
FIG. 4 is an enlarged end view of one of the slitter/perforators of FIG. 3.

Adjustment lock knobs 56 in FIGS. 3 and 4 have been rotated counterclockwise and housings 53 moved toward each other to position housings 80 and perforating wheels 84 in a selected perforating position and tightened by clockwise rotation. In this position the perforation wheels 84 will perforate a sheet in two locations in the direction of movement of the sheet. Slitter/perforator 50 allows an operator to select up to two slits and two perforations for each job with individual perforation and slit housings being placed in any location desired over the entire 17" process width of an 11×17" sheet or any other sheet of less dimension. Sheets driven through the nip formed between O-ring 86 and cylinder 55, as shown in FIG. 4, will be perforated by perforation wheel 84 which extends slightly above the plane of the sheets and immediately adjacent cylinder 54. Cylinders 54 and 82 are keyed into grooves 72 and 76 for rotation by pins 58 and 83, respectively. As seen in FIGS. 3 and 4, when housing portion 53 is moved in the direction of the arrow, cylinder 55 contacts perforator wheel 84 to move the perforator wheel in unison with the cylinder and housing 53. This same action takes place when slitters are used instead of perforators as shown in FIGS. 5 and 6.

Figure 5:
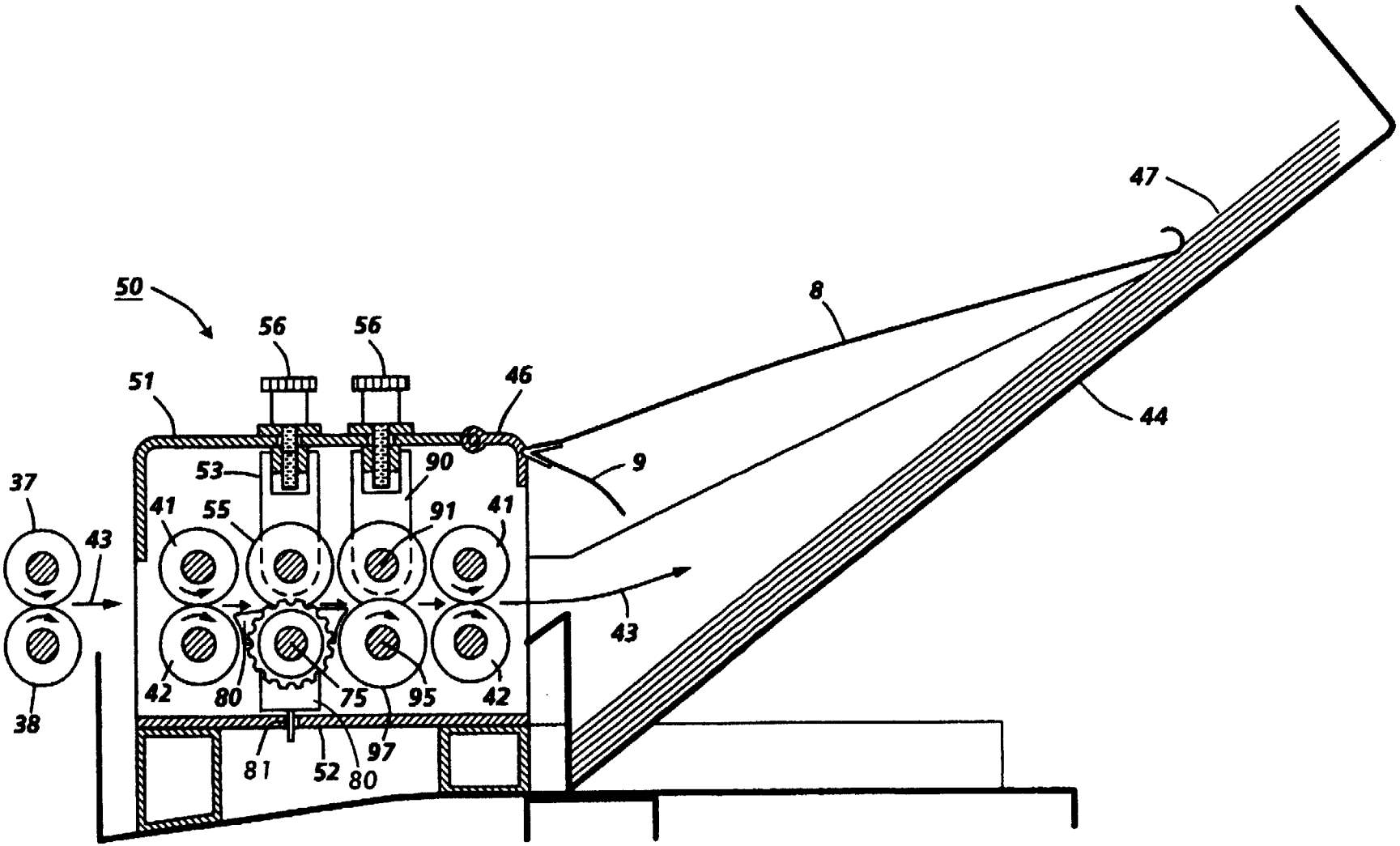
FIG. 5 is an enlarged partial side view of the slitter/perforator of FIG. 1.

Sheets entering slitter/perforator 50 in FIG. 5 are driven by rollers 37 and 38 of machine 5 into housing 51 and into a nip formed between drive rollers 41 and 42 in the direction of arrows 43 that represent the path of sheets transported through the slitter/perforator. If the slitter/perforator 50 is actuated, perforator wheel 84 places perforations in the sheet as it passes thereover and slitter 97 supported by shaft 95 slits the sheets before they are driven out into output tray 44 by another set of drive rollers 41 and 42. The sheets can continue to stack up as they enter output tray 44 until the height of the stacked sheets causes a full condition and causes a corrugation in the paper path which lifts door 46 which has a conventional limit switch (not shown) attached thereto. Lifting of the door by the stacked sheets actuates the limit switch which stops the machine. Paper guides 8 ensure that the lead edges of sheets 47 are properly positioned in tray 44 and trail edges of the copy sheets are guided down and out of the path of incoming copy sheets by trail edge guides 9. Registration of copy sheets for straight perforations and slits with respect to the image on the copy sheets is enabled by rotating knob 18 counterclockwise and pivoting slitter/perforator 50 until the perforation(s) and slit(s) are straight. The slitter/perforator is mounted on a plate that has two shoulder screw openings in the outbound end thereof with a shoulder screw mounted in one opening and knob 18 mounted with the other opening and two U-shaped slots at the endbound end of the plate with shoulder screws mounted in each for movement of the plate clockwise or counterclockwise in a horizontal plane. Other means could be used to pivot slitter/perforator 50, if desired. For example, the slitter/perforator 50 could be mounted on a plate with knob 18 mounted in the outbound end thereof along with shoulder screws on the endboard end thereof.

Figure 6:
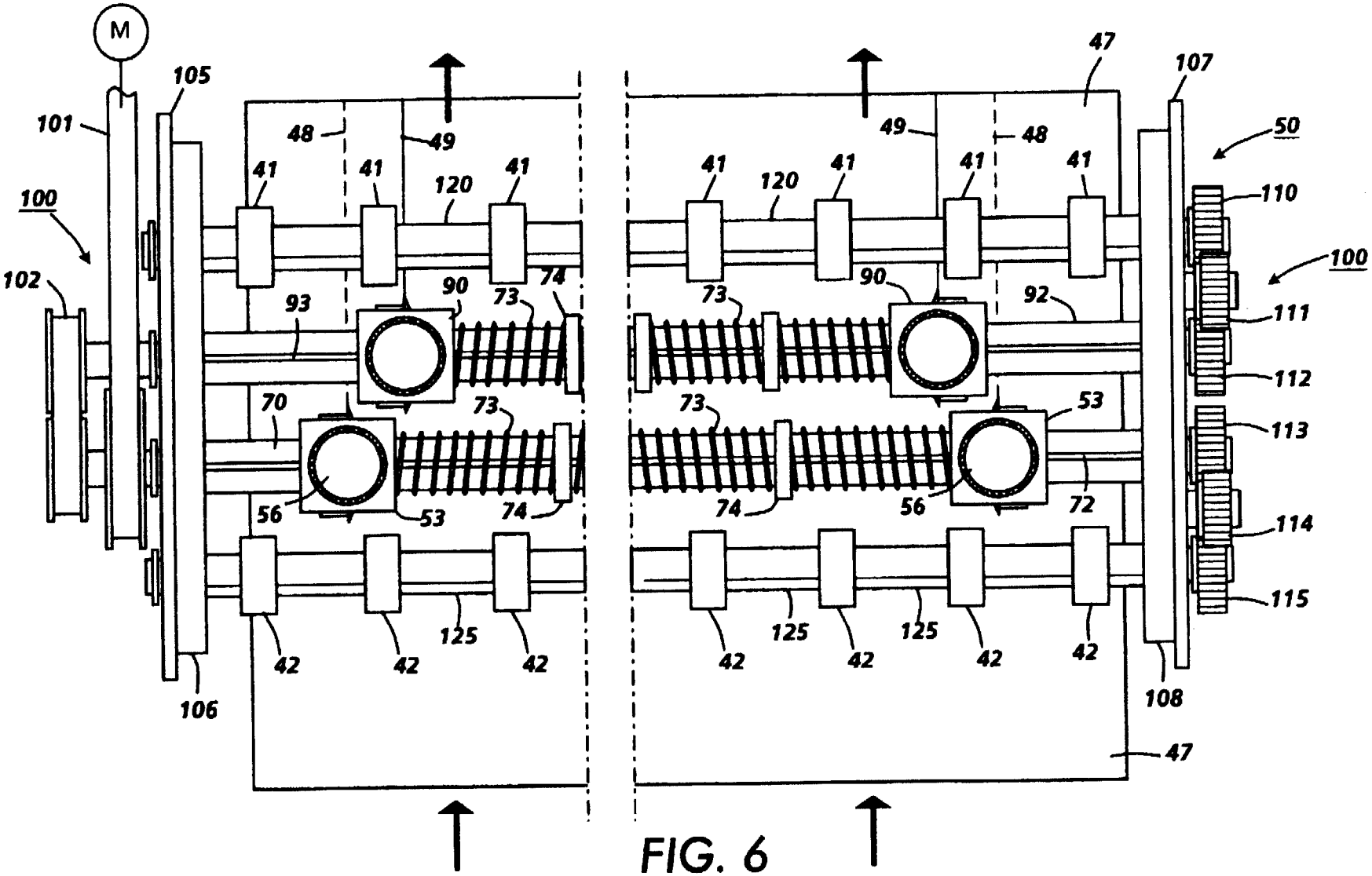
FIG. 6 is an enlarged plan view of the slitter/perforator of FIG. 1 showing a copy sheet being perforated and slit.

Sheets 47 passing through slitter/preforator 50 as seen in FIG. 6, are driven by motor M through a pulley/gear system 100 that includes belts 101 and 102 with the pulleys being connected to gears 110, 111, 112, 113, 114 and 115 through shafts 70, 92, 120 and 125. Gears 110, 112, 113 and 115 are driving gears while gears 111 and 114 are idler gears. The pulley system is mounted onto U-shaped frame member 105 and 107 and attachment blocks 106 and 108 and drives copy sheets 47 in the direction of the arrows through rollers 42 into perforator housing 53 where perforations 48 takes place and through slitter 90 supported by shaft 91 where the copy sheets are slit along line 49 and driven out of the slitter/perforator into output tray 44. It should be understood that the plurality of slitters and perforators can be located at any position along their respective shafts and enterchanged as desired, i.e., a perforator and slitter could be placed on the same shaft, or all slitters all perforators could be used.

Compact, modular, low cost slitter/perforator 50 has many advantages over slitters and perforators of the past including the fact that it is top adjustable, operator adjustable; adjustable while copy sheets are moving through it; can be turned ON and OFF separately from the machine; can slit and perforate at the same time up to 11×17" long edge fed sheets; has paper guides that move with the adjustment lock knobs; can slit and perforate in the process direction at all locations along an 11×17" copy sheet; it uses long and small wire diameter springs to present a nearly constant sliding force to an operator adjusting the position of slitter and perforator housings; and the slitters and perforators are interchangeable on all shafts to give multiple different configurations.

It should now be apparent that a top adjustable slitter/perforator accessory for paper handling machine has been disclosed that features operator adjustable options while the machine operates with controls easily accessible to the operator and no wrenches are required to make slit or perforation adjustments.

While the embodiment shown herein is preferred, it will be appreciated that it is merely one example, and that various alterations, modifications, variations or improvements thereon may be made by those skilled in the art from this teaching, which is intended to be encompassed by the following claims:

What is claimed is:

1. In a reproduction machine which feeds imaged copy sheets to an output tray, the improvement of a slitter and/or perforator for slitting and/or perforating the copy sheets immediately prior to their entering the output tray of the machine, comprising:

a housing;

at least one first shaft rotatably positioned within said housing in a predetermined plane;

at least one second shaft rotatably supported within said housing, said second shaft being positioned underneath and in said predetermined plane of said at least one first shaft;

at least one perforator unit having a first portion thereof mounted for transverse movement along said at least one first shaft and a second portion thereof mounted for transverse movement along said at least one second shaft, said first portion of said perforator unit including means thereon which contacts said second portion of said perforator unit as said first portion of said perforator unit is moved along said at least one first shaft so that said second portion of said perforator unit moves in unison with said first portion of perforator unit as said perforator unit is moved to a predetermined location; and a single lock adjustment knob adapted to be turned to facilitate movement of said perforator unit along said first and second shafts, and wherein said single lock adjustment knob includes a threaded portion attached thereto and a movable oval shaped pin mounted on said threaded portion of said single lock adjustment knob, and wherein said single lock adjustment knob is connected to said oval shaped pin and adapted such that as said single lock adjustment knob is manipulated clockwise, said oval shaped pin presses against said housing locking said first portion of said perforator unit against lateral movement.

2. In a reproduction machine which feeds imaged copy sheets to an output tray, the improvement for slitting and/or perforating the copy sheets immediately prior to their entering the output tray of the machine, comprising:

a housing;

at least one first shaft rotatably positioned within said housing in a predetermined plane;

at least one second shaft rotatably supported within said housing, said second shaft being positioned underneath and in said predetermined plane of said at least one first shaft;

a perforator unit having a first portion thereof mounted for transverse movement along said at least one first shaft and a second portion thereof mounted for transverse movement along said at least one second shaft, said first portion of said perforator unit including means thereon which contacts said second portion of said perforator unit as said first portion of said perforator unit is moved along said at least one first shaft so that said second portion of said perforator unit moves in unison with said first portion of perforator unit as said perforator unit is moved to a predetermined location;

copy sheet guide means mounted on at least one of said shafts and separate and laterally spaced from said perforator unit; and means for adjusting the positioning of said perforator unit along said first and second shafts.

3. The improvement of claim 2, wherein said copy sheet guide means comprises cylindrical washers that are adapted to stay centered with respect to said perforator unit when adjustments are made to said perforator unit due to contact with low rate spring means, said low rate spring means being adapted to apply side load on said units.

4. The improvement of claim 2, including third and fourth shafts positioned downstream from said first and second shafts and wherein said third and fourth shafts include at least one slitter unit mounted thereon for slitting copy sheets passing therethrough, said at least one slitter unit having a first portion mounted on said third shaft and a second portion which has a slitting blade therein mounted on said fourth shaft; and wherein said copy sheet guide means comprises cylindrical washers that are adapted to stay centered with respect to said perforator and/or slitter units when adjustments are made to said perforator and/or slitter units due to contact with low rate spring means, said low rate spring means being adapted to apply side load on said units.

* * * * *